United States Patent [19]

Zanetta et al.

[11] 4,432,534

[45] Feb. 21, 1984

[54] OXYGEN LANCE FOR STEEL CONVERTER

[75] Inventors: Hugues Zanetta, St. Julien-les-Metz; Daniel Richard, Metz, both of France

[73] Assignee: Institut de Recherches de la Siderurgie Francaise, Saint Germain-en-Laye, France

[21] Appl. No.: 465,559

[22] Filed: Feb. 10, 1983

[30] Foreign Application Priority Data

Feb. 10, 1982 [FR] France ..... 82 02173

[51] Int. Cl.[3] ..... C21C 5/32

[52] U.S. Cl. ..... 266/225; 266/266; 75/60; 239/124; 239/132.3; 239/565

[58] Field of Search ..... 266/225, 266, 217; 239/124, 132.3, 565; 75/60

[56] References Cited

U.S. PATENT DOCUMENTS

| | | | |
|---|---|---|---|
| 3,141,763 | 7/1964 | Foresi et al. | 75/60 |
| 3,338,570 | 8/1967 | Zimmer | 239/132.3 |
| 3,411,716 | 11/1968 | Stephan et al. | 266/225 |

FOREIGN PATENT DOCUMENTS

| | | | |
|---|---|---|---|
| 1446612 | 8/1976 | United Kingdom | 266/225 |
| 840119 | 6/1981 | U.S.S.R. | 266/266 |

*Primary Examiner*—L. Dewayne Rutledge
*Assistant Examiner*—Robert McDowell
*Attorney, Agent, or Firm*—Michael J. Striker

[57] ABSTRACT

A gas-injection lance has a main tube centered on an axis and having a lower end formed adjacent the axis with a plurality of throughgoing inner orifices and an upper end to which is fed a treatment gas under pressure that pressurizes the interior of the tube therewith sufficiently that the gas exits from the lower end through the inner orifices at supersonic speed. An annular array of nozzles traversing the lower tube end around the inner orifices each have an outer end opening outside of the tube and an inner end inside the tube. Respective pressure-reducers each have one side open at the lower tube end inside the tube and another side connected to the inner end of a respective nozzle for passing gas from the interior of the tube into the nozzles with a substantial pressure reduction so that the gas exits from the outer ends of the nozzles at subsonic speed. The pressure-reducers each comprise a body forming a chamber of predetermined flow cross section into which the respective inner nozzle end opens and an inlet on the body having an opening of flow cross section much smaller than that of the chamber and of the respective nozzle.

12 Claims, 5 Drawing Figures

OXYGEN LANCE FOR STEEL CONVERTER

FIELD OF THE INVENTION

The present invention relates to a gas-injection lance. More particularly this invention concerns a lance used to inject oxygen into a converter during the LD refining of steel.

BACKGROUND OF THE INVENTION

In the LD or LD-AC conversion of pig iron into steel, oxygen is blown at high pressure directly down through a lance onto the bottom of the melt in the converter vessel. In addition a secondary oxygen stream afterburns the carbon monoxide generated by the refining process, creating harmless carbon dioxide and generating useful heat. The primary stream that is responsible for the conversion must be at very high pressure and typically exits from the lower end of the lance at supersonic speeds. The secondary stream that burns off the gaseous byproducts is at much lower pressure, typically exiting from the lower end of the lance at subsonic speeds, and annularly surrounds the primary stream.

Although both streams are of the same gas, pure oxygen, the pressures needed are so different that separate supply pipes are needed as well as complex remote pressure-regulating systems. Obviously this complicates the structure of the lance which itself is exposed to high temperatures and is otherwise in a very harsh environment.

OBJECTS OF THE INVENTION

It is therefore an object of the present invention to provide an improved gas-injection lance.

Another object is the provision of such a gas-injection lance which overcomes the above-given disadvantages.

A further object is to provide such a lance wherein separate supply lines for the two oxygen streams are not needed.

Yet another object is to provide a lance having a single oxygen feed, but wherein the pressure of at least the secondary stream can be varied relatively easily.

SUMMARY OF THE INVENTION

These objects are attained according to the instant invention in a gas-injection lance having a main tube centered on an axis and having a lower end formed adjacent the axis with a plurality of throughgoing inner orifices and an upper end and means for feeding a treatment gas under pressure to the upper end and thereby pressurizing the interior of the tube therewith sufficiently that the gas exits from the lower end through the inner orifices at supersonic speed. An annular array of nozzles traversing the lower tube end around the inner orifices each have an outer end opening outside of the tube and an inner end inside the tube. Respective pressure-reducing means each have one side open at the lower tube end inside the tube and another side connected to the inner end of a respective nozzle for passing gas from the interior of the tube into the nozzles with a substantial pressure reduction so that the gas exits from the outer ends of the nozzles at subsonic speed.

Thus a single supply of high-pressure oxygen is all that is needed. The necessary pressure reduction for the secondary stream is carried out right at the lower nozzle end by passive elements that can be counted on to have a long service life. In fact the lance according to this invention can easily be retrofitted on a single-flow prior-art lance merely by rebuilding its lower end.

The pressure-reducing means according to this invention comprises a body forming a chamber of predetermined flow cross section into which the respective inner nozzle end opens and an inlet on the body having an opening of flow cross section much smaller than that of the chamber. The nozzles are of a flow cross section substantially larger than that of the respective inlet openings but smaller than that of the respective chambers and the flow cross section of the orifices is greater than that of the chambers. For optimum pressure reduction each of the chambers has a volume substantially greater than that of the respective nozzle between its inner and outer ends. It would also be possible to feed several nozzles from a single such pressure-reduction chamber having a single inlet.

It is possible to provide the lance according to this invention with means for varying the flow cross section of the inlet opening. This means can comprise a valve body displaceable toward the inlet opening to restrict same and away from it to open it up and actuator means operable remotely for displacing the valve body relative to the inlet. The actuator can be mechanical, normally fluid powered, or can comprise a simple mechanical linkage.

The varying means can also constitute structure forming a closed chamber around a flexible annular membrane forming the inlet opening and means for pressurizing the closed chamber and thereby restricting the inlet opening. This system makes it easy to control all the nozzles for joint operation.

The nozzles according to this invention are formed by nozzle tubes traversing the lower tube end. The chambers are formed by further chamber tubes extending upwardly from the inner ends of the nozzle tubes and having upper ends provided with the respective inlets. Thus relatively simple structure right at the lower lance end effects the desired pressure reduction.

The orifices open at a slight angle to the lance axis, so they form a powerful but narrow downwardly extending end flaring stream of oxygen. The nozzles surround the orifices but are inclined more outward so they form a more flared annular secondary stream that is frustoconical and that surrounds the primary stream. In this manner excellent secondary combustion of the gaseous byproducts of the refining operation is ensured.

DESCRIPTION OF THE DRAWING

The above and other features and advantages will become more readily apparent from the following, reference being made to the accompanying drawing in which.

SPECIFIC DESCRIPTION

Figure 1:
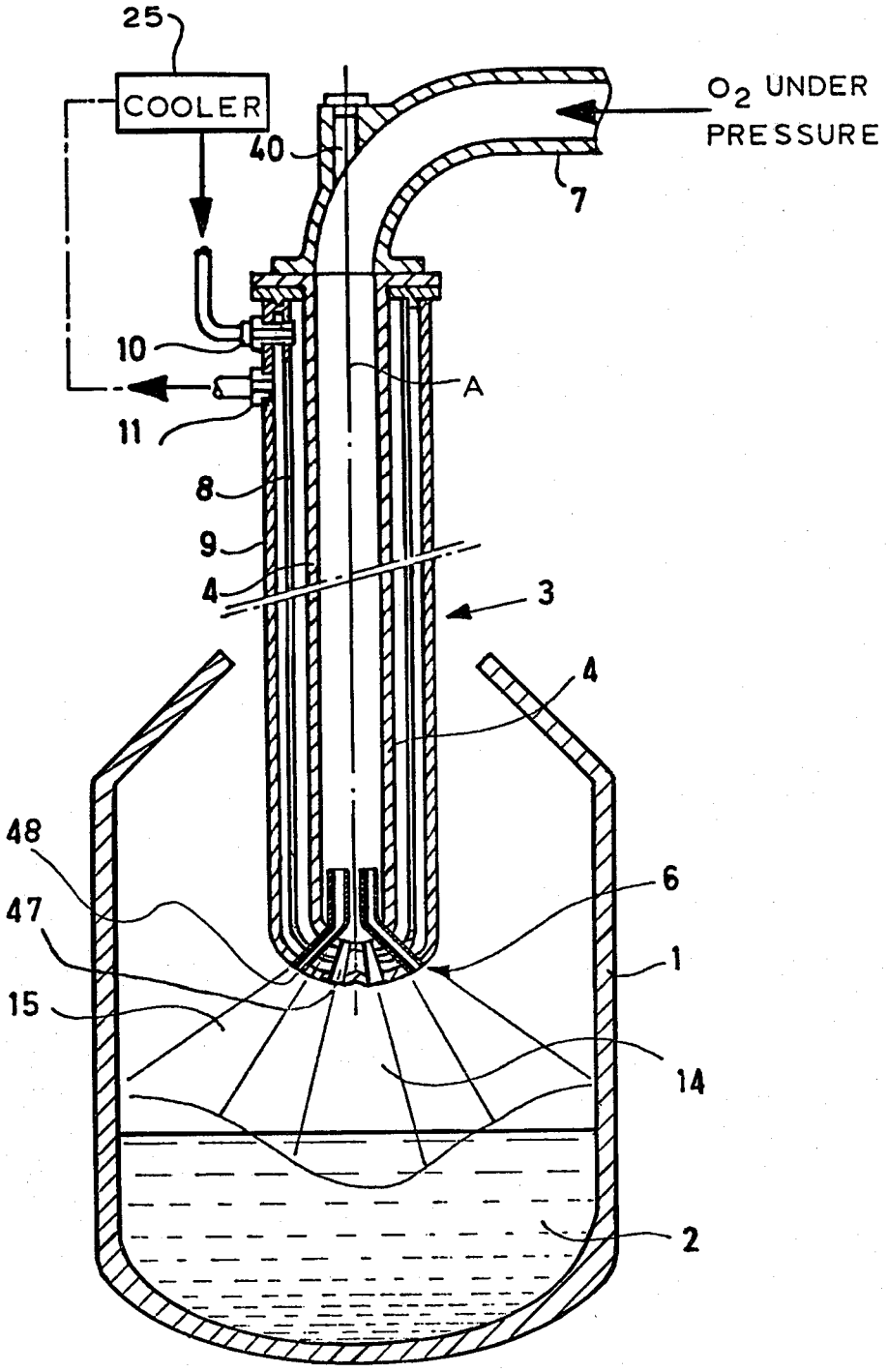
FIG. 1 is a small-scale partly diagrammatic view mainly in axial section through the apparatus according to this invention.

As seen in FIG. 1 a standard LD or LD-AC converter 1 contains a bath or melt 2 of molten pig iron. A lance indicated generally at 3 is supplied with pure oxygen at a pressure of at least 2 bar and at most 20 bar, normally 10 bar–15 bar. The lance 3 has a lower end 6 from which a high-pressure primary stream 14 of oxygen issues through holes 47 (see also FIG. 5) and an annular low-pressure secondary stream 15 issues through surrounding holes 48 opening at a greater angle to the axis A of the lance than the holes 47.

Figure 2:
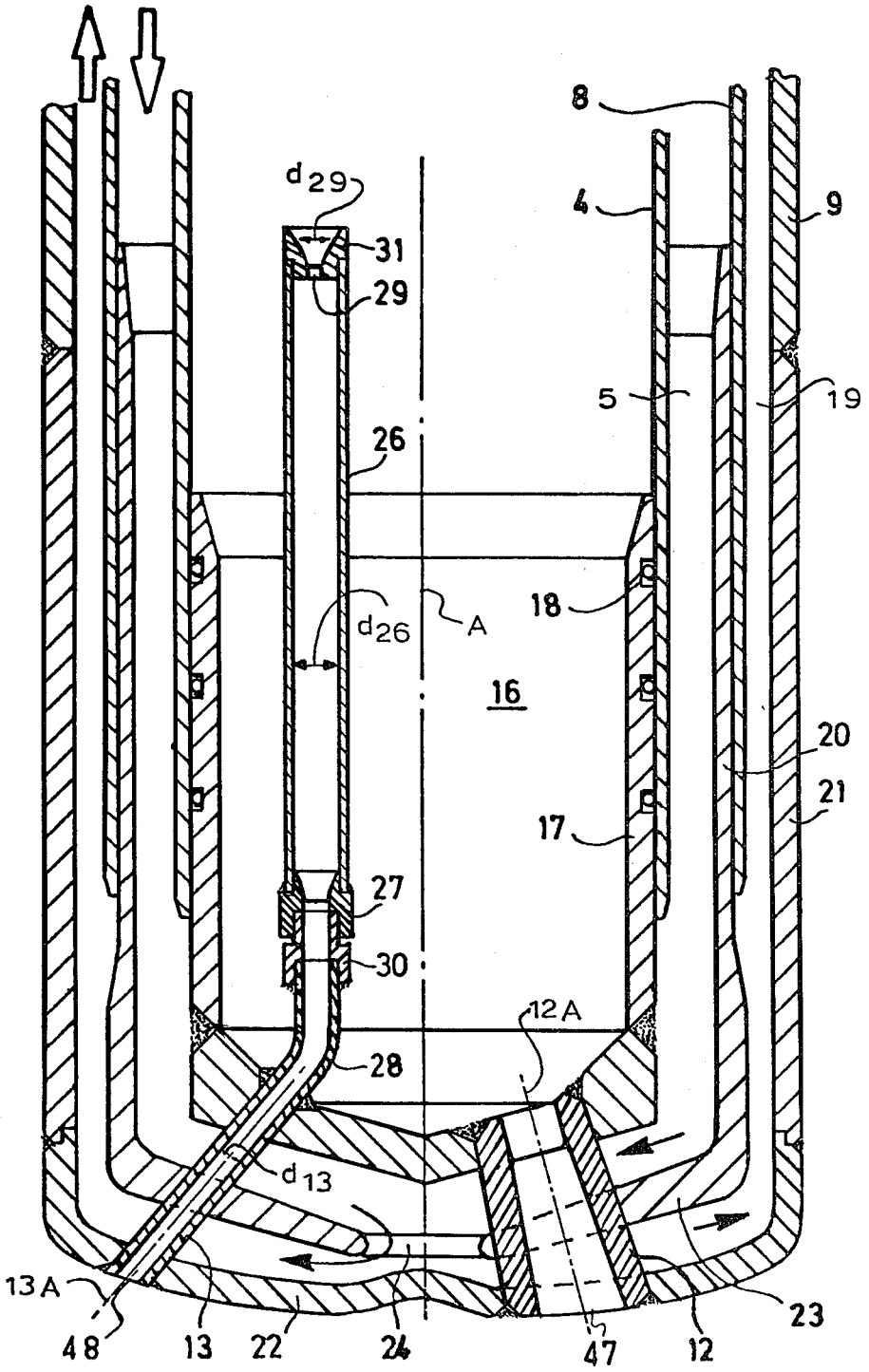
FIG. 2 is a large-scale view of a detail of FIG. 1.

As shown also in FIG. 2 the lance 3 includes an inner tube or pipe 4 centered on the axis A and connected at its upper end to an oxygen-supply conduit 7. At its lower end it is closed by a cap 17 that is snugly fitted inside it and that is sealed relative to it by O-rings 18 so this cap 17 can move limitedly axially in the tube 4 to compensate for the inevitable thermal expansion and contraction in use.

Figure 5:
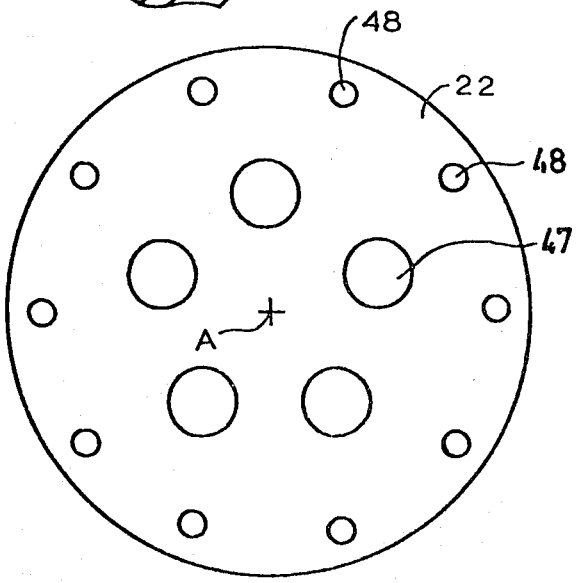
FIG. 5 is a bottom view of the detail shown in FIG. 2.

Surrounding the tube 4 and forming a cylindrically annular chamber 5 therewith is a tubular inner jacket 8 and surrounding it and forming another cylindrically annular chamber 19 therewith is a tubular outer jacket 9. The inner jacket 8 is provided at its lower end with a welded-on cap 20 that extends inward toward the axis A as shown at 23 and that is formed in the center at the axis A with a large axially throughgoing hole 24. The outer jacket 9 is butt-welded at its end to a cap 21 having an end surface 22 at which the openings 47 and 48 are formed as shown in FIG. 5. A cooler 25 feeds cool water through a fitting 10 into the inner chamber 5 so that it flows axially down therein, then through the hole 23 into the chamber 19 in which it flows axially up and leaves through a fitting 11 to return to the cooler 25. The openings 47 are five in number and are angularly equispaced about and radially equispaced from the axis A. They are formed by respective downwardly slightly flaring tubes 12 centered on axes 12*a* forming angles of about 15° with the axis A. These tubes 12 are welded between the caps 21 and 17 and traversing the jacket end 23. These tubes 12 are of relatively great flow across section and open directly into the interior 16 of the tube at its lower end so that the central primary stream formed by them is of oxygen moving at supersonic speed.

The openings 48 are ten in number and are angularly equispaced about and radially equispaced from the axis A. They are formed by respective small-diameter nozzle tubes 13 centered on axes 13*a* forming angles of about 40° with the axis A and welded between the caps 21 and 17 and traversing the jacket end 23. These tubes 12 are of relatively small flow cross section and have inner upper ends formed with elbows that turn upward parallel to the axis A and that are welded to respective threaded couplings 30.

In order that the oxygen issuing from the nozzles 13 and forming the annular secondary stream 15 moves at subsonic speed, a pressure-reduction chamber 26 formed by a tube of diameter $d_{26}$ is provided on the inner nozzle end. This tube 26 has a screw fittng 27 by means of which it is secured to the fitting 30 and at its upper end has an inlet fitting 31 formed with an inlet opening 29 of relatively small diameter $d_{29}$. The nozzle tube 13 has a diameter $d_{13}$ which is substantially greater than the diameter $d_{29}$ but somewhat smaller than the diameter $d_{26}$ and has a rectified length substantially shorter than the axial length of the tube 26 between its end fittings 31 and 27, the latter of which tapers downward.

Thus even through the interior 16 is at relatively high pressure—10 bars to 15 bars—the pressure inside the tubes 26 will be much less, due to the small inlet opening 29 for oxygen entry and the relatively large exit passage formed by the nozzle-tube 13. In this manner the oxygen forming the outer stream 15 will leave the holes 48 at subsonic speed which is ideal for burning off gaseous conversion byproducts.

In the system of FIGS. 1, 2, and 5 it is possible to vary the pressure of the stream 14 by varying the overall pressure, and to vary that of the stream 15 proportionately by changing the subassemblies 26, 27, 31 with ones of different inlet-opening diameter $d_{29}$.

Figure 3:
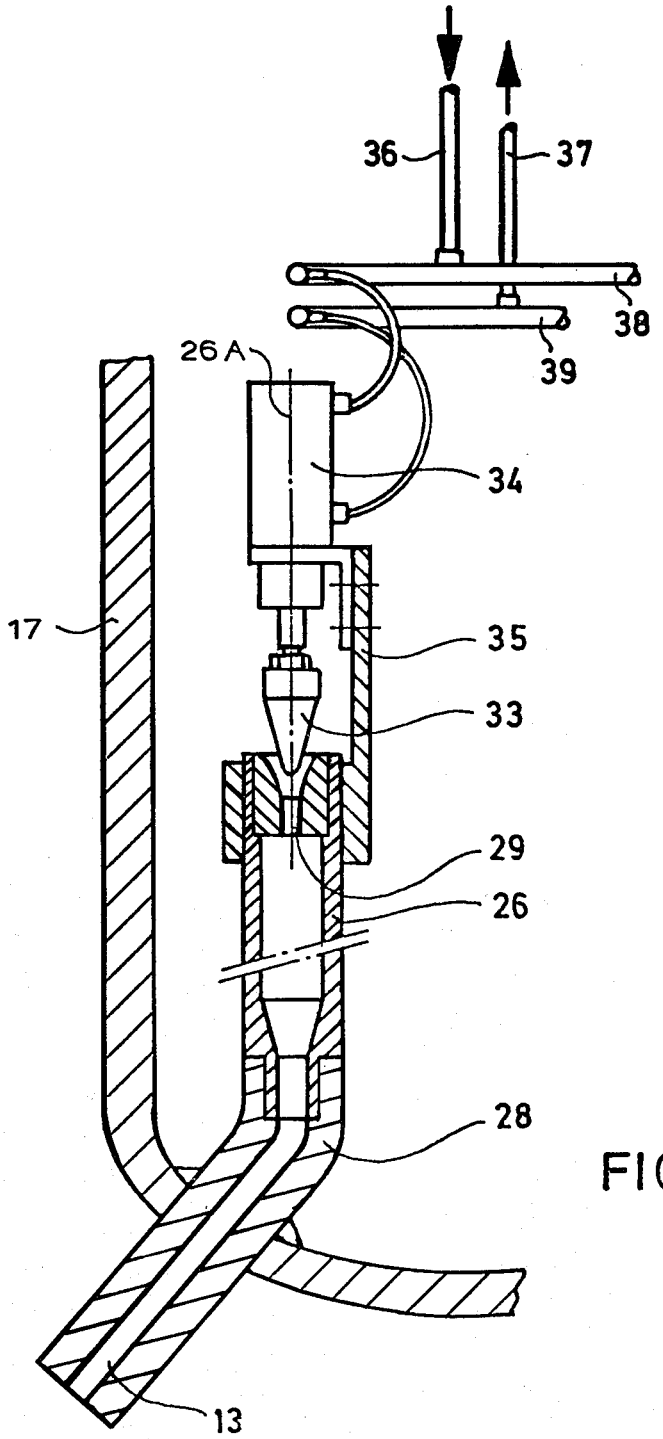
FIGS. 3 and 4 are large-scale sectional views of details of variant systems according to the invention.

FIG. 3 shows an arrangement wherein the upper end of the tube 26 is provided with a mount 35 carrying a double-acting fluid-powered cylinder 34 having a tapered valve body 33 that can move along the axis 26A of the tube 26. The back and front chambers of the cylinder 34 are pressurized from manifolds 38 and 39 in turn pressurized through lines 36 and 37 that can extend out of the lance 4 through a normally plugged opening 40 (FIG. 1). All ten of the cylinders 34 for the nozzles 13 are connected together for joint synchronous displacement. Such a system makes it possible to increase the oxygen feed to the outer secondary stream when there is insufficient afterburning of the gaseous conversion products, mainly carbon monoxide, and to decrease it when afterburning is complete and oxygen is being wasted.

Figure 4:
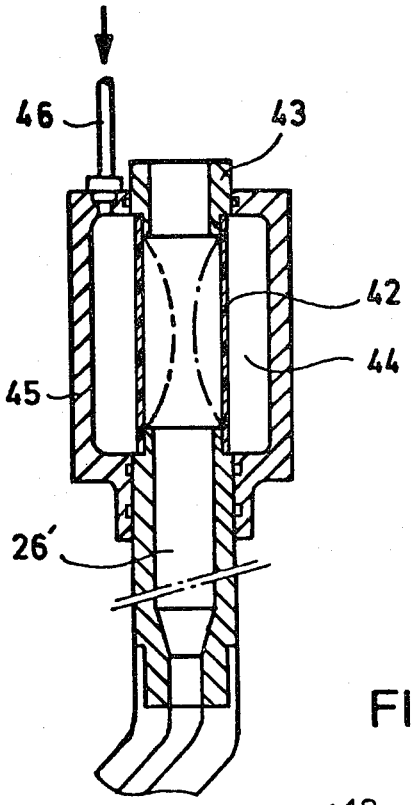

It is also possible as shown in FIG. 4 to replace the tubes 26 with tubes 26' each having an upper inlet end formed by an annular flexible membrane 42 that has an upper end secured to a fixed-diameter inlet ring and a lower end fixed to the top of the tube 26'. A housing 45 surrounding the membrane 42 forms a closed annular compartment 44 therewith and a fluid-supply tube 46 is connected to this chamber 44 so it can be pressurized to deflect the membrane 4 inward as shown by dot-dash lines. Thus as pressure in the chamber 44 increases the flow cross section of the inlet of the tube 26' decreases and vice versa. All the chambers 44 are normally connected together for joint and synchronous regulation of all the inlet openings.

With the system of this invention it is therefore possible to use a single oxygen supply but to create two different streams. The structure is simple and can easily be retrofitted on an existing lance for afterburning of carbon monoxide in a system not originally set up for such operation.

We claim:

1. A gas-injection lance comprising:

a main tube centered on an axis and having a lower end formed adjacent the axis with a plurality of throughgoing inner orifices and an upper end;

means for feeding a treatment gas under pressure to the upper end and thereby pressurizing the interior of the tube therewith sufficiently that the gas exits from the lower end through the inner orifices at supersonic speed;

an annular array of nozzles traversing the lower tube end around the inner orifices and each having an outer end opening outside of the tube and an inner end inside the tube; and respective pressure-reducing means each having one side open at the lower tube end inside the tube and another side connected to the inner end of a respective nozzle for passing gas from the interior of the tube into the nozzles with a substantial pressure reduction so that the gas exits from the outer ends of the nozzles at subsonic speed.

2. The gas-injection lance defined in claim 1, further comprising means including at least one jacket surrounding the tube for cooling same.

3. The gas-injection lance defined in claim 1 wherein the pressure-reducing means includes:

a body forming a chamber of predetermined flow cross section into which the respective inner end opens; and an inlet on the body having an opening of flow cross section much smaller than that of the chamber.

4. The gas-injection lance defined in claim 3 wherein the nozzles are of a flow cross section substantially larger than that of the respective inlet openings but smaller than that of the respective chambers.

5. The gas-injection lance defined in claim 4 wherein the flow cross section of the orifices is greater than that of the chambers.

6. The gas-injection lance defined in claim 3 wherein each of the chambers has a volume substantially greater than that of the respective nozzle between the inner and outer ends.

7. The gas-injection lance defined in claim 3, further comprising:

means for varying the flow cross section of the inlet opening.

8. The gas-injection lance defined in claim 7 wherein the means for varying includes:

a valve body displaceable toward the inlet opening to restrict same and away from it to open it up; and means operable remotely for displacing the valve body relative to the inlet.

9. The gas-injection lance defined in claim 7 wherein the inlet opening is formed by a flexible annular membrane, the varying means including:

structure forming a closed chamber around the membrane; and means for pressurizing the closed chamber and thereby restricting the inlet opening.

10. The gas-injection lance defined in claim 3 wherein the nozzles are formed by nozzle tubes traversing the lower tube end, the chambers being formed by further chamber tubes extending upwardly from the inner ends of the nozzle tubes and having upper ends provided with the respective inlets.

11. The gas-injection lance defined in claim 1 wherein the orifices are arranged in a ring centered on the axis and open outwardly at a predetermined acute angle relative to the axis, the nozzles being arranged on a ring centered on the axis and surrounding the orifices and opening outwardly at an acute angle greater than that of the orifices.

12. In combination with a top-blown oxygen-type metallurgical converter, a gas-injection lance comprising:

a main tube centered on an axis and having a lower end formed adjacent the axis with a plurality of throughgoing inner orifices and an upper end;

means for feeding a treatment gas under pressure to the upper end and thereby pressurizing the interior of the tube therewith sufficiently that the gas exits from the lower end through the inner orifices at supersonic speed;

an annular array of nozzles traversing the lower tube end around the inner orifices and each having an outer end opening outside of the tube and an inner end inside the tube; and respective pressure-reducing means each having one side open at the lower tube end inside the tube and another side connected to the inner end of a respective nozzle for passing gas from the interior of the tube into the nozzles with a substantial pressure reduction so that the gas exits from the outer ends of the nozzles at subsonic speed.

* * * * *